US006454478B2

(12) United States Patent
Wotton et al.

(10) Patent No.: US 6,454,478 B2
(45) **Date of Patent: *Sep. 24, 2002**

(54) HEATED VACUUM PLATEN

(75) Inventors: Geoff Wotton, Battle Ground; Steve O. Rasmussen, Vancouver, both of WA (US)

(73) Assignee: Hewlett-Packard Co., Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/878,632

(22) Filed: Jun. 11, 2001

Related U.S. Application Data

(63) Continuation of application No. 09/469,128, filed on Dec. 21, 1999.

(51) Int. Cl.[7] ..... B41J 2/01

(52) U.S. Cl. ..... 400/656; 400/662; 101/488; 347/101; 347/102; 347/104

(58) Field of Search ..... 400/651, 653, 400/655, 656, 657, 661.1, 661.2, 662; 101/487, 488; 347/101, 102, 103, 104

(56) References Cited

U.S. PATENT DOCUMENTS 4,237,466 A 12/1980 Scranton
5,329,295 A 7/1994 Medin et al.
5,399,039 A 3/1995 Giles et al.
D358,417 S 5/1995 Medin et al.
5,420,621 A 5/1995 Richtsmeier et al.
5,461,408 A 10/1995 Giles et al.
5,510,822 A 4/1996 Vincent et al.
5,742,315 A 4/1998 Szlucha et al.
5,757,407 A 5/1998 Rezanka
6,168,269 B1 * 1/2001 Rasmussen et al. ..... 347/102
6,224,203 B1 5/2001 Wotton et al.
6,315,404 B1 * 11/2001 Wotton et al. ..... 101/424.1
6,328,440 B1 * 12/2001 Medin et al. ..... 271/7
6,336,722 B1 * 1/2002 Wotton et al. ..... 347/102

FOREIGN PATENT DOCUMENTS

GB 2339520 1/2000

* cited by examiner

*Primary Examiner*—Ren Yan
*Assistant Examiner*—Kevin D. Williams

(57) ABSTRACT

Predetermined geometric constructs reduce heat loss in a vacuum platen and assist in the reduction of paper cockle in ink-jet printing. A vacuum platen for supporting media during printing is provided with a plurality of heating elements and surfaces interspersed with vacuum ports. The heater elements are laid into surface channels of the platen such that an insulative gap separates the heaters from the main platen support structure. In an alternative embodiment, an insulative gasket is provided for the gap.

7 Claims, 3 Drawing Sheets

HEATED VACUUM PLATEN

This is a continuation of application Ser. No. 09/469,128 filed on Dec. 21, 1999.

BACKGROUND OF THE INVENTION

Field of the Invention

The present invention relates generally to ink-jet technology and, more particularly to a heated printing zone vacuum platen. p 2. Description of the Related Art The art of ink-jet technology is relatively well developed. Commercial products such as computer printers, graphics plotters, copiers, and facsimile machines employ ink-jet technology for producing hard copy. The basics of this technology are disclosed, for example, in various articles in the *Hewlett-Packard Journal,* Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions. Ink-jet devices are also described by W. J. Lloyd and H. T. Taub in OUTPUT HARDCOPY [sic] DEVICES, chapter 13 (Ed. R. C. Durbeck and S. Sherr, Academic Press, San Diego, 1988). As providing background information, the foregoing documents are incorporated herein by reference.

It is known to use a vacuum induced force to adhere a sheet of flexible material to a surface, for example, for holding a sheet of print media temporarily to a platen. [Hereinafter, "vacuum induced force" is also referred to as "vacuum induced flow,""vacuum flow," or more simply as just "vacuum" or "suction," as best fits the context.] Such vacuum holddown systems are a relatively common, economical technology to implement commercially and can improve hard copy apparatus throughput specifications. For example, it is known to provide a rotating drum with holes through the surface wherein a vacuum through the drum cylinder provides a suction force at the holes in the drum surface (see e.g., U.S. Pat. No. 4,237,466 (Scranton)). [The term "drum" as used hereinafter is intended to be synonymous with any curvilinear implementation incorporating the present invention; while the term "platen" can be defined as a flat holding surface, in hard copy technology it is also used for curvilinear surfaces, such as the ubiquitous typewriter rubber roller; thus, for the purposes of the present application, "platen" is used generically for any shape paper holddown surface used in a hard copy apparatus.] Permeable belts traversing a vacuum inducing support have been similarly employed (see e.g., Scranton and U.S. patent application Ser. No. 09/163,098 by Rasmussen et al. for a BELT DRIVEN MEDIA HANDLING SYSTEM WITH FEEDBACK CONTROL FOR IMPROVING MEDIA ADVANCE ACCURACY (assigned to the common assignee of the present invention and incorporated herein by reference)).

Generally in a hard copy apparatus implementation, the vacuum device is used either to support cut-sheet print media during transport to a printing station of a hard copy apparatus, to hold the sheet media at the printing station while images are formed (known as the "printing zone"), or both. [In order to simplify discussion, the term "paper" is used hereinafter to refer to all types of print media and the term "printer" to refer to all types of hard copy apparatus; no limitation on the scope of the invention is intended nor should any be implied.]

Typically thermal ink-jet inks are water based and when deposited on wood-based papers, they are absorbed into the cellulose fibers, causing the fibers to swell. As the cellulose fibers swell, they generate localized expansions, causing the paper cockle. Not only does this create a finished hard copy product that may be objectionable to the end-user, cockle growth can cause actual degradation of ink dot printing quality itself due to uncontrolled pen-to-paper spacing which may even, in turn, lead to pen printhead-to-paper contact as the cockle waves move a region of the paper upwardly.

Moreover, most commercial ink-jet printers allow the paper to exit the printing zone on a flat platen or into a substantially flat output tray while the ink is drying. A flat platen with no post-printing holddown mechanism allows cockle to expand, generally creating larger waves in the sleet of paper.

Furthermore, in order to produce high quality color copy, e.g., photo-quality printing, ink flux is increased to produce vivid color saturation. This flux increase further exacerbates the paper cockle problem.

Still further, ink-jet printhead size is increasing to increase throughput. As the print zone length increases, ink bleed effects and the paper cockle problem are again enlarged or intensified.

Several solutions to these problems have been developed. U.S. Pat. No. 4,329,295 (Medin et al.) for a PRINT ZONE HEATER SCREEN FOR THERMAL INK-JET PRINTER, U.S. Pat. No. 5,461,408 (Giles et al.) for a DUAL FEED PAPER PATH FOR INK-JET PRINTER, U.S. Pat. No. 5,399,039 (Giles et al.) for an INK-JET PRINTER WITH PRECISE PRINT ZONE MEDIA CONTROL, U.S. Pat. No. 5,420,621 (Richtsmeier et al.) for a DOUBLE STAR WHEEL FOR POST-PRINTING MEDIA CONTROL IN INKJET PRINTING, and Des. Pat. No. 358,417 (Medin et al.) (each is assigned to the common assignee of the present invention and incorporated herein by reference) exemplify various techniques for a hard copy apparatus using conventional electromechanical paper feed systems. U.S. Patent No. 5,742,315 (Szlucha et al.) shows a SEGMENTED FLEXIBLE HEATER FOR DRYING A PRINTED IMAGE. A segmented flexible heater is disposed adjacently to a paper path for heating a recording medium before and during printing.

There remains a need for print zone and post-print zone paper path transport mechanisms that assist in reducing the expanding paper cockle problem. One solution is to hold the paper to a platen with a vacuum force during printing. However, it has been found that with vacuum holding creates a higher frequency, or "sharper" looking, cockle wave in the paper. The geometric complexities of designing a vacuum transport type apparatus compounded by the heating of the transported flexible material creates a need for improved heat distribution mechanisms. In ink-jet printing applications, there is a need for vacuum holddown paper path systems that assist in reducing or substantially eliminating paper cockle.

SUMMARY OF THE INVENTION

In a basic aspects the present invention provides a print media vacuum holddown device, including: supporting mechanisms for supporting a print media transport belt, having a first pattern of vacuum passages therethrough for distributing vacuum across a support surface, the support surface having a second pattern of surface mechanisms for containing heating mechanisms interspersed with the first pattern of vacuum passages; and heating mechanisms for generating heat for transmission to the belt, wherein the heating mechanisms are inset within the surface mechanisms such that the heating mechanisms are substantially surrounded by a gap from the supporting mechanisms wherein the supporting mechanisms is insulated from heat emitted by the heating mechanisms.

In another basic aspect, the present invention provides a hard copy apparatus, including: a printing station; proximate the printing station, writing mechanisms for printing on print media; transport mechanisms for selectively transporting the print media into and out of the printing station; and mounted proximate the printing station adjacently to the writing mechanisms, vacuum platen mechanisms for supporting print media transported through the printing station, the platen mechanisms including supporting mechanisms for supporting a print media transport belt, having a first pattern of vacuum ports therethrough and a support surface having a second pattern of surface channels interspersed with the first pattern of vacuum ports, and heating mechanisms for transmitting heat to the belt, inset within the surface channels such that the heating mechanisms are substantially surrounded by a gap from the supporting mechanisms wherein the supporting mechanisms is insulated from heat emitted by the heating mechanisms.

Another basic aspect of the present invention is a method for heating a print medium in a printing zone of a hard copy apparatus having a vacuum inducing subsystem, including the steps of: providing a vacuum holddown and positioning the holddown in the printing zone; interspersing electrical heating elements with vacuum ports across a surface of the holddown such that the heating elements are isolated from the surface by a gap; and transporting the print medium through the printing zone on a belt in superjacent contact with the platen at least in the printing zone while reducing cockle from ink droplets deposited on the medium and heat loss via the vacuum subsystem.

In another basic aspect, the present invention provides a method for heating on a print medium in a printing zone of a hard copy apparatus having a vacuum inducing subsystem, including the steps of: positioning a vacuum holddown having an electrically resistive, heat emitting surface in the printing zone, the surface have passageways therethrough coupled to the vacuum inducing system; and transporting the print medium through the printing zone on a belt in superjacent direct contact with the surface at least in the printing zone, using the surface for reducing cockle from ink droplets deposited on the medium while reducing heat loss via the vacuum subsystem.

Some advantages of the present invention are:

it reduces the spread of thermal mass and therefore the attendant amount of energy and time to bring a heater tip to operating temperature;

it reduces the loss of thermal energy through the vacuum platen structure itself due to the intrinsic air flow design;

it substantially eliminates thermal mass induced lang and resultant non-uniform temperature profiles in the printing zone;

it reduces spreading of undesirable heat to adjacent parts of the hard copy apparatus and vacuum subsystems;

it uses materials conducive to faster rise time to operating temperatures;

it provides a vacuum transport for ink-jet paper transport which will reduce cockling;

it reduces or substantially eliminates thermal expansion induced problems; and it limits heat loss through the vacuum subsystem and the concomitant need for more powerful and efficient heating subsystems, thus reducing cost of manufacture.

The foregoing summary and list of advantages is not intended by the inventor to be an inclusive list of all the aspects, objects, advantages and features of the present invention nor should any limitation on the scope of the invention be implied therefrom. This Summary is provided in accordance with the mandate of 37 C.F.R. 1.73 and M.P.E.P. 608.01(d) merely to apprize the public, and more especially those interested in the particular art to which the invention relates, of the nature of the invention in order to be of assistance in aiding ready understanding of the patent in future searches.

Other objects, features and advantages of the present invention will become apparent upon consideration of the following detailed description and the accompanying drawings, in which like reference designations represent like features throughout the figures.

The drawings referred to in this description should be understood as not being drawn to scale except if specifically noted.

DETAILED DESCRIPTION OF THE INVENTION

Reference is made now in detail to a specific embodiment of the present invention, which illustrates the best. mode presently contemplated by the inventors for practicing the invention. Alternative embodiments are also briefly described as applicable.

Figure 1:
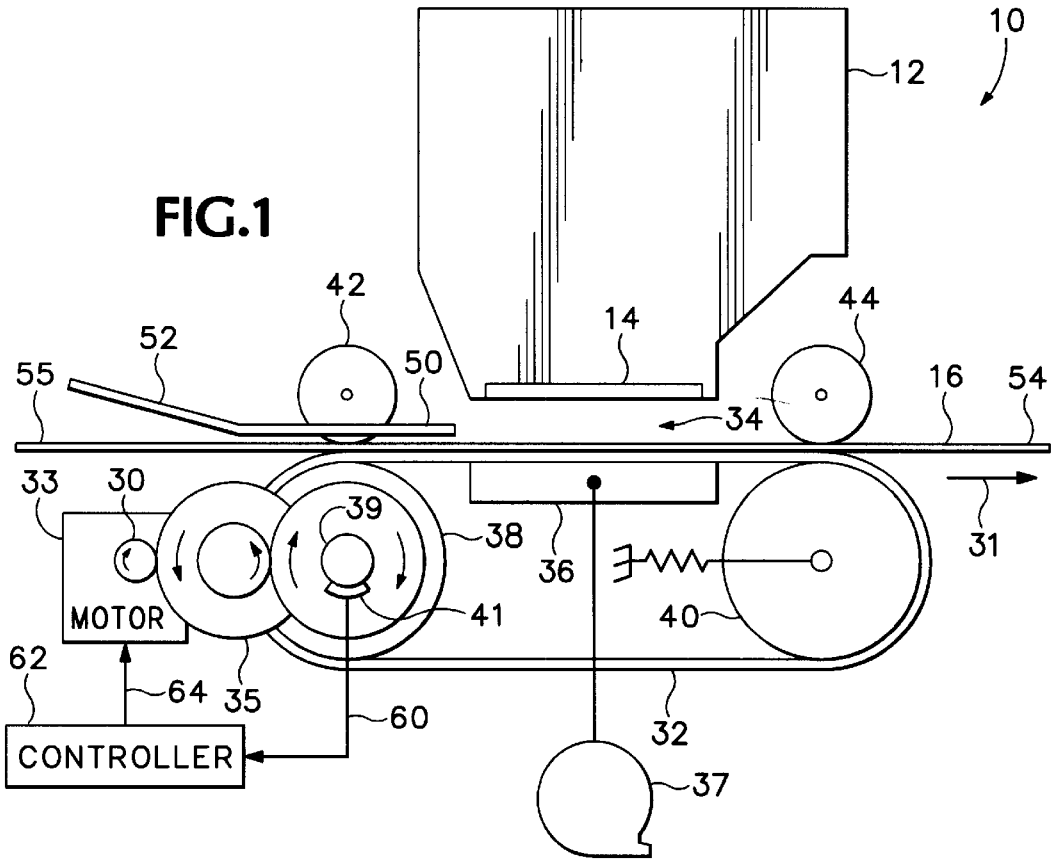
FIG. 1 is a schematic depiction of an ink-jet hard copy apparatus 10 in accordance with the present invention.
Figure 2:
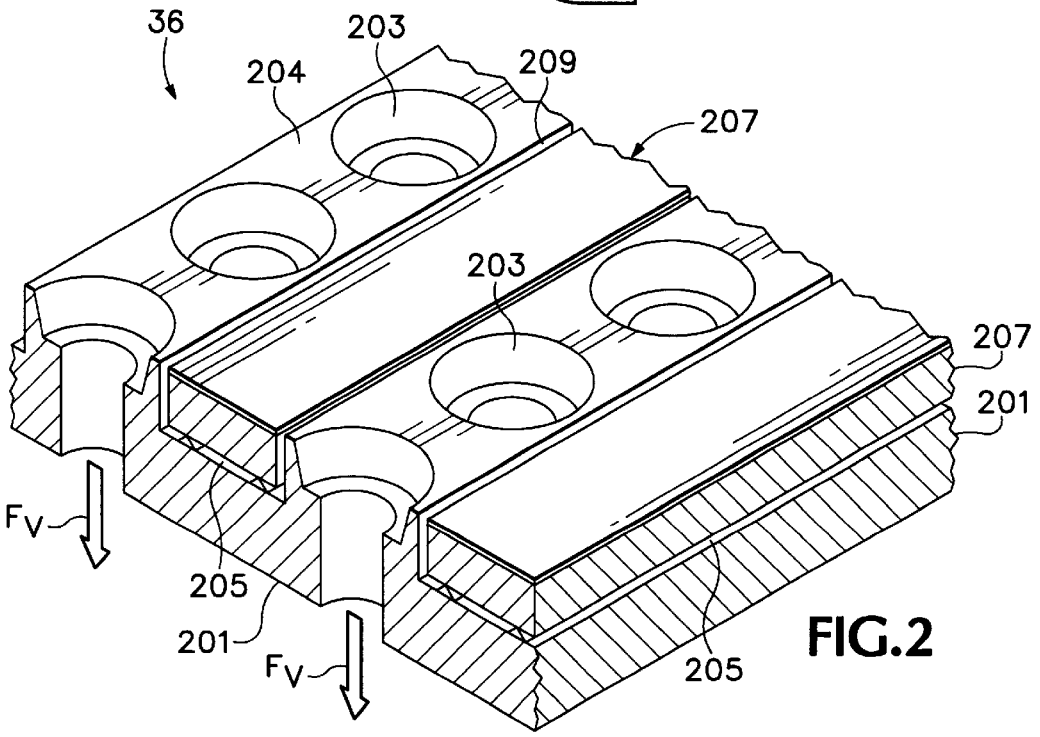
FIG. 2 is a detail segment schematic of the platen in accordance with the present invention shown in FIG. 1.

FIG. 1 is a schematic depiction of an ink-jet hard copy apparatus 10 in accordance with the present invention. A writing instrument 12 is provided with a printhead 14 having drop generators including nozzles for ejecting ink droplets onto an adjacently positioned print medium, e.g., a sheet of paper 16, in the apparatus printing zone 34. [The word "paper is used hereinafter for convenience as a generic term for all print media; the implementation shown is for convenience in explaining the present invention and no limitation on the scope of the invention is intended by the inventors nor should any be implied.] An endless-loop belt 32 is one type of known manner printing zone input-output paper transport. A motor 33 having a drive shaft 30 is used to drive a gear train 35 coupled to a belt pulley 38 mounted on an fixed axle 39. A biased idler wheel 40 provides appropriate tensioning of the belt 32. The belt rides over a platen 36 in the print zone 34; the platen is described in detail hereinafter, but is associated with a known manner vacuum induction system 37. The paper sheet 16 is picked from an input supply (not shown) and its leading edge 54 is delivered to a guide 50, 52 where a pinch wheel 42 in contact with the belt 32 takes over and acts to transport the paper sheet 16 through the printing zone 34 (the paper path is represented by arrow 31). Downstream of the printing zone 34, an output roller 44 in contact with the belt 32 receives the leading edge 54 of the paper sheet 16 and continues the paper transport until the trailing edge 55 of the now printed page is released, FIG. 2 illustrates the details of the vacuum platen 36 device of the hard copy apparatus 10. [It is also contemplated that the construct of the present invention be adapted for use as a vacuum transport subsystem or other vacuum holddown such as might be used for picking a sheet of paper and moving the sheet to the printing zone, providing an additional advantage of preheating the sheet before depositing ink drops, while depositing ink, and post-printing. In order to simplify the detailed description, the word "platen" is used generically; no limitation on the scope of the invention is intended nor should any be implied.] A vacuum manifold 201 is fabricated of a thermally nonconductive material. A plurality of vacuum passageways, or ports, 203 is distributed across the platen surface 204 such that a vacuum will draw down through the ports—represented by arrows labeled "Fv." Some thermally nonconductive materials suitable for employment in the present invention are thermoset or thermoplastic materials having a low coefficient of thermal expansion, for example, glass-filled polycarbonate, LCP, polyetherimide. The geometric thickness, and material combination can be tailored to a specific implementation.

Interspersed with the pattern of vacuum ports 203 is a set of platen surface channels 205. Inlaid within each of the channels is a strip heater 207 (other patterns and shapes may be employed in accordance with the present invention). The heaters 207 are connected to a power source (not shown), such as via or on the hard copy apparatus controller 62 (FIG. 1) in any convenient known manner.

The use of known resistor trace technology is advantageous in that resistance and therefore heat generated can be predetermined by varying the thickness of the trace.

As will be apparent to a person skilled in the art; the specific implementation of the structure just described will be related to the hard copy apparatus design and performance specifications; e.g., a platen 36 for a desktop computer peripheral printer will differ from a fax machine or a large engineering drawing plotter. Therefore specific shapes and dimensions for the platen and each sub-component of the platen will vary widely.

Figure 3:
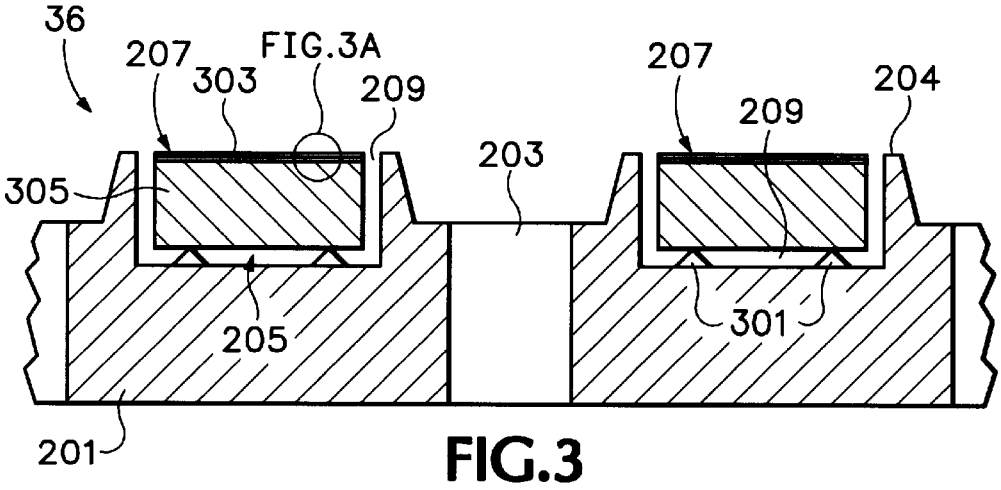
FIG. 3 is a schematic depiction in cross-section of the present invention as shown in FIG. 2.

An important aspect of the present invention is that an air gap 209 is provided between the heaters 207 and the side and end walls and the floor of each associated surface channel 205. Turning also to FIG. 3, a set of standoffs 301 is provided in the floor of each channel 205 for mounting the heaters 207 such that the air gap 209 surrounds each heater 207, substantially isolating it from the vacuum manifold 201.

Figure 3A:
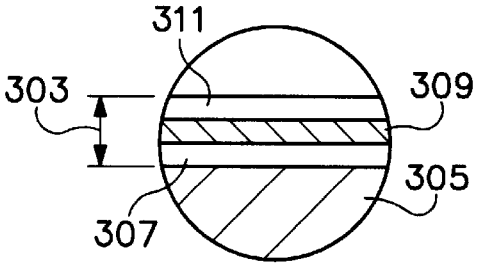
FIG. 3A is a close-up detail from FIG. 3.

In a first embodiment the heaters 207 are fabricated as a thick film 303 on a stainless steel or ceramic material substrate as illustrated in FIG. 3A. Generally, a thick film 303 resistive layer, or conductor, 309 can be formed using resistor paste commercially available from Electro-Science Laboratories, Inc., King of Prussia, Pa.; other processes or thick film heating devices known in the art can also be employed. Tape processing methods are alternatively used to thick film techniques for application on a substrate.

Superjacent the stainless steel substrate 305 is a layer of an electrical insulator 307, the conductor 309, and a low abrasive surface insulator 311. It has been found that the use of a glass coating surface insulator 311 provides a wear resistant, low coefficient of friction layer between the heater 207 and the belt 32 (FIG. 1) as it traverses the platen 36. The thickness of the insulator 311 is chosen based on the specific implementation such that abrasion of the belt 32 is minimized.

Merely to provide some idea as to appropriate dimensions, in an exemplary test bed for an ink-jet desktop computer printer, the heater 207 was formed to have a stainless steel substrate approximately one millimeter thick and three millimeters wide; the triple layer thin film was approximately seventy-five to ninety micrometers thick; the vacuum ports 203 had a diameter in the range of about 0.1 to 3.0 millimeters; and a 50% porosity flexible belt 32 having a thickness in the range of approximately 0.003–0.007 inch thick sized for A-size and B-size paper was successfully operated.

Figure 3B:
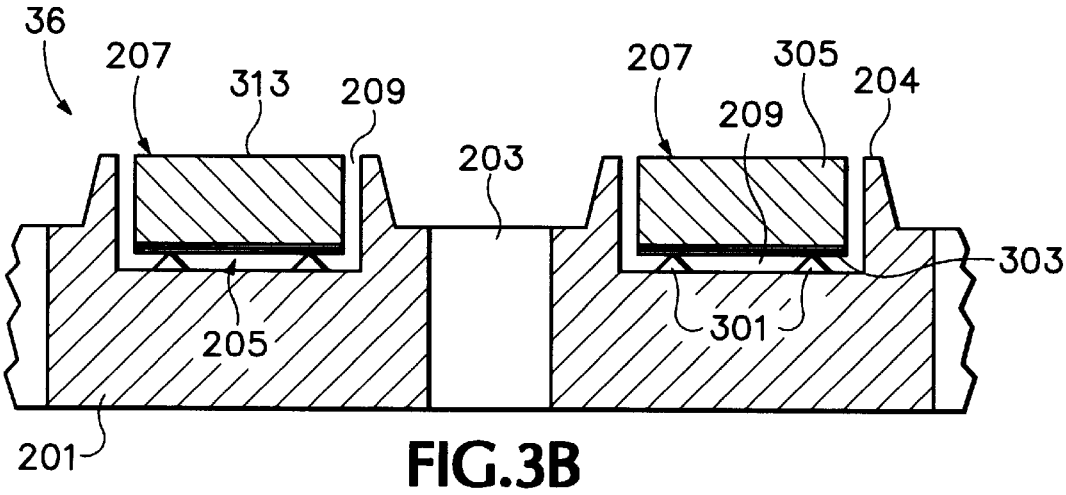
FIG. 3B is an alternative embodiment of the present invention as shown in FIGS. 2 and 3.

FIG. 3B is an alternative to the embodiment of FIG. 3. In some applications, it may be advantageous to partially reduce the amount of heat transferred from the heater 207 to the over-riding belt 32 (FIG. 1). It has been found that the same heater structure can be inverted so that the heat from the thick film heater 303 laminate dissipates uniformly through the stainless steel 305. When appropriately coated or polished, the top surface 313 provides a suitable low friction contact with the adjacent belt 32.

Figure 4:
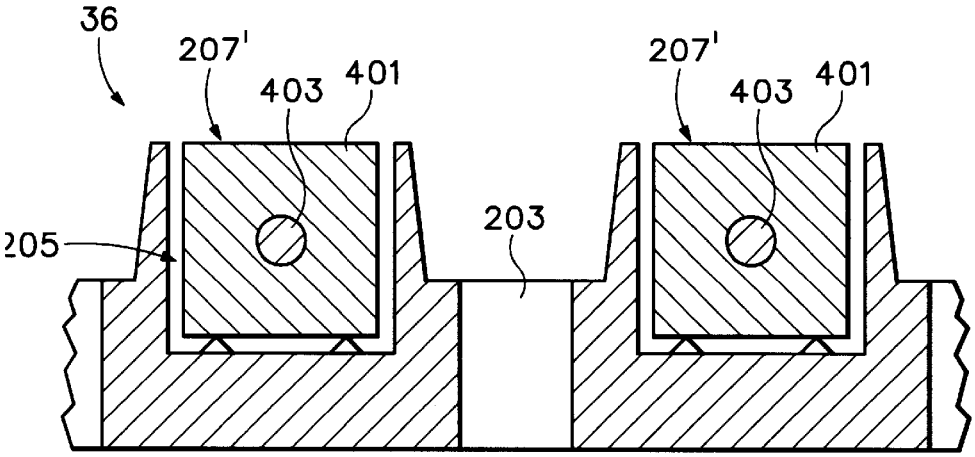
FIG. 4 is an alternative embodiment schematic depiction in cross-section of the present invention.

FIG. 4 demonstrates an alternative embodiment employing strip heaters 207' in channels 205. A heater casing 401 is formed of a thermoset plastic. A Nichrome wire 403 is embedded in the plastic and connected to the power source. In a similar test bed to the aforementioned, a three millimeter square heater 207' was successfully employed.

Figure 5:
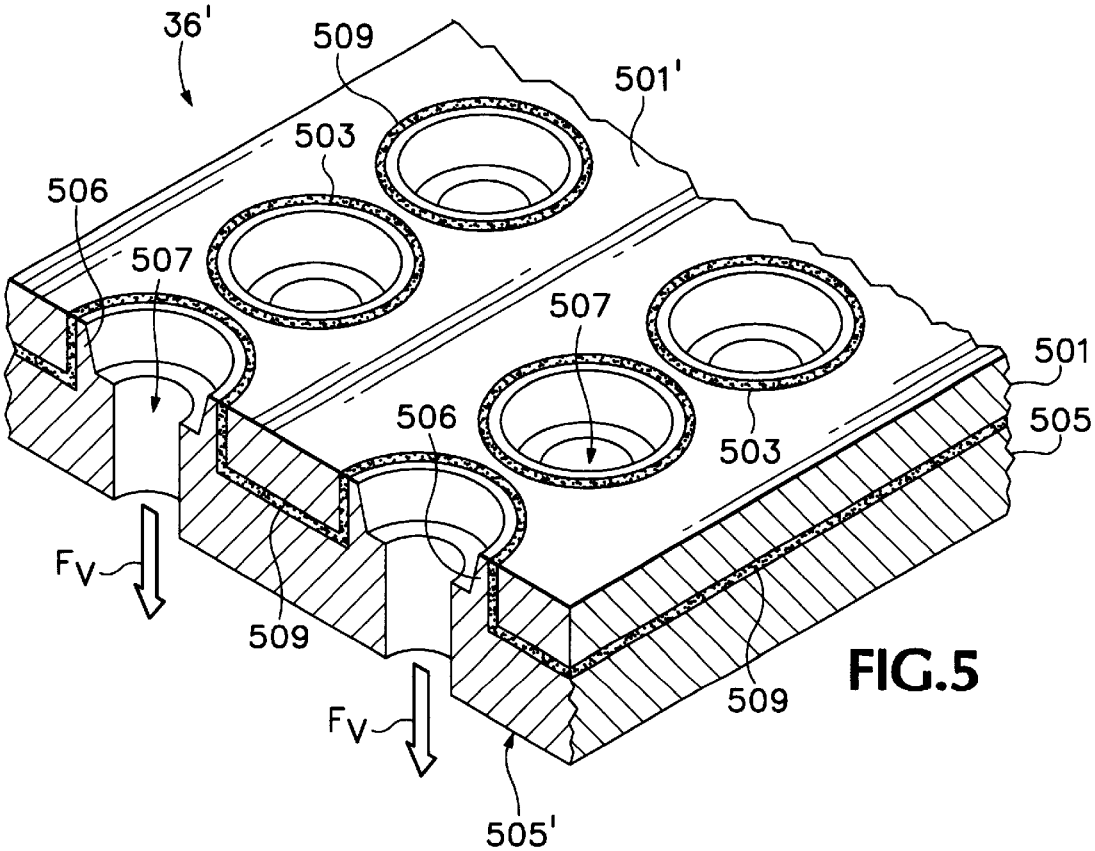
FIG. 5 is an alternative embodiment schematic of the present invention illustrated in a cross-section perspective view.

FIG. 5 is an alternative embodiment of a platen 36' for the present invention. A one piece heater 501 having a plurality of apertures 503 is constructed of stainless steel. A base plate 505 is formed of a thermoplastic or thermoset material having a plurality of apertured pillars 506 extending into the apertures 503 of the heater 501 and forming a vacuum Fv passageway 507. A gasket 509, such as of silicone foam, is layered between the heater 501 and the base plate 505. In the geometric complexity of forming an efficient heater-platen for ink-jet uses, this alternative offers a simplicity of construction. Note also that again, either the heater 501 bottom surface 501' or the base plate 505 top surface 505' may be employed as the non-abrasive contact surface with the belt 32 (FIG. 1) with minor modifications to the construct to ensure appropriate vacuum Fv flow.

The foregoing description of the present invention has been presented for purposes of illustration and description. It is not intended to be exhaustive or to limit the invention to the precise form disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application to thereby enable others skilled in the art to understand the invention for various embodiments and with various modifications as are suited to the particular use contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase: "means for . . . "

What is claimed is:

1. A method for heating on a print medium in a printing zone of a hard copy apparatus having a vacuum inducing subsystem, the method comprising:

providing a platen having a top surface having passageways therethrough coupled to the vacuum inducing subsystem, said surface also having electrically resistive heating elements interspersed with the passageways;

positioning the platen in the printing zone; and transporting the print medium through the printing zone on a belt in superjacent direct contact with the surface at least in the printing zone, wherein the surface is configured such that cockle from ink droplets deposited on the medium is reduced and heat loss via the vacuum subsystem is minimized by thermally isolating the heating elements from said passageways by an air gap. gasket.

2. The method as set forth in claim 1 wherein said direct contact is further provided in a pre-printing zone.

3. The method as set forth in claim 1 wherein said direct contact is further provided in a post-printing zone.

4. The method as set forth in claim 1 wherein said heat loss is reduced by thermally isolating heating elements of said surface from said passageways.

5. A method for heating on a print medium in a printing zone of a hard copy apparatus having a vacuum inducing subsystem, the method comprising:

providing a platen having a top surface having passageways therethrough coupled to the vacuum inducing subsystem, said surface also having electrically resistive heating elements interspersed with the passageways;

positioning the platen in the printing zone; and transporting the print medium through the printing zone on a belt in superjacent direct contact with the surface at least in the printing zone, wherein the surface is configured such that cockle from ink droplets deposited on the medium is reduced and heat loss via the vacuum subsystem is minimized by thermally isolating the heating elements from said passageways by a gasket.

6. A heated platen for a vacuum belt, comprising:

a belt support having a first distribution of vacuum ports therethrough; and interspersed with said ports, heater elements isolated from said ports by insulating means such that heat loss is minimized wherein said heater elements form a belt contact surface of the support mounted superjacently to the support wherein said belt contact surface has a substantially identical first distribution of vacuum apertures therethrough in alignment with said vacuum ports wherein said insulating means thermally isolates said belt contact surface from said support.

7. The platen as set forth in claim 6 wherein said heater elements are located for direct contact with said vacuum belt.

* * * * *